US006116876A

United States Patent [19]

Kitano et al.

[11] Patent Number: 6,116,876

[45] Date of Patent: Sep. 12, 2000

[54] SCROLL TYPE COMPRESSOR HAVING AN ABRASION-RESISTANT MEANS BETWEEN A CRANK PIN AND A MOVABLE SCROLL IN AN AXIAL DIRECTION

[75] Inventors: Norio Kitano, Fujioka; Yuji Yoshii, Takasaki, both of Japan

[73] Assignee: Sanden Corporation, Gunma, Japan

[21] Appl. No.: 09/312,059

[22] Filed: May 17, 1999

[30] Foreign Application Priority Data

May 19, 1998 [JP] Japan ..... 10-136640

[51] Int. Cl.[7] ..... F01C 1/02

[52] U.S. Cl. ..... 418/55.2; 418/55.1; 418/178

[58] Field of Search ..... 418/55.2, 55.1, 418/178

[56] References Cited

U.S. PATENT DOCUMENTS

| | | | |
|---|---|---|---|
| 4,435,137 | 3/1984 | Terauchi | 418/55.1 |
| 4,457,676 | 7/1984 | Hiraga | 418/55.1 |
| 5,201,646 | 4/1993 | Dees et al. . | |
| 5,277,564 | 1/1994 | Tamura et al. | 418/55.6 |

FOREIGN PATENT DOCUMENTS

| | | | |
|---|---|---|---|
| 0430853 | 6/1991 | European Pat. Off. . | |
| 4336713 | 5/1994 | Germany . | |
| 58148291 | 9/1983 | Japan . | |
| 1-182588 | 7/1989 | Japan | 418/55.2 |
| 2-9972 | 1/1990 | Japan | 418/55.2 |
| 2-112685 | 4/1990 | Japan | 418/55.2 |

OTHER PUBLICATIONS

European Search Report, Issued Aug. 2, 1999.

*Primary Examiner*—Thomas Denion
*Assistant Examiner*—Theresa Trieu
*Attorney, Agent, or Firm*—Baker Botts L.L.P.

[57] ABSTRACT

A fixed scroll (16) and a movable scroll (18) cooperatively define compressing chambers therebetween. The movable scroll is driven by a crank pin (12) eccentrically attached to a shaft (11) which is rotated by an external driving source. A surface treatment for abrasion resistance is applied to at least one of an end surface of the crank pin and a confronting end plate of the movable scroll. It may also be arranged that an abrasion-resistant plate is interposed between the end surface of the crank pin and the confronting end plate of the movable scroll.

8 Claims, 3 Drawing Sheets

SCROLL TYPE COMPRESSOR HAVING AN ABRASION-RESISTANT MEANS BETWEEN A CRANK PIN AND A MOVABLE SCROLL IN AN AXIAL DIRECTION

BACKGROUND OF THE INVENTION

The present invention relates to a scroll type compressor which is suitable for use in, for example, an air conditioner mounted on an automobile.

In general, such a scroll type compressor comprises a crank pin eccentrically provided on a shaft, a movable scroll driven by the crank pin, and a fixed scroll which defines compressing chambers cooperatively with the movable scroll. The shaft and the movable scroll are rotatably supported via bearings. By rotating the shaft using a driving means such as an automobile engine, the movable scroll makes a circular orbital motion relative to the fixed scroll while being prevented from rotation on its axis. The circular orbital motion of the movable scroll relative to the fixed scroll introduces fluid into the compressing chambers, compresses the fluid in the compressing chambers, and discharges the compressed fluid.

In the scroll type compressor of this type, however, it is possible that an end plate of the movable scroll confronting an end surface of the crank pin and the end surface of the crank pin confronting the end plate of the movable scroll may abut and slide relative to each other in an assembling process. In this case, there is raised a problem that abrasion powder is produced due to the abutment and sliding between the end plate of the movable scroll and the end surface of the crank pin, or that they adhere to each other.

SUMMARY OF THE INVENTION

It is therefore an object of the present invention to provide a scroll type compressor which can prevent generation of abrasion powder or adhesion which would be otherwise caused due to abutment and sliding between an end plate of a movable scroll and an end surface of a crank pin.

Other objects of the present invention will become clear as the description proceeds.

According to the present invention, there is provided a scroll type compressor which comprises a rotatable shaft extending in an axial direction, a crank pin eccentrically provided on the shaft and having an end surface perpendicular to the axial direction, a movable scroll driven by the crank pin and having an end plate confronting the end surface of the crank pin, a fixed scroll cooperated with the movable scroll for defining a compressing chamber therebetween, and abrasion-resistant means for preventing abrasion between the end surface of the crank pin and the end plate of THe movable scroll.

DESCRIPTION OF THE PREFERRED EMBODIMENTS

Figure 1:
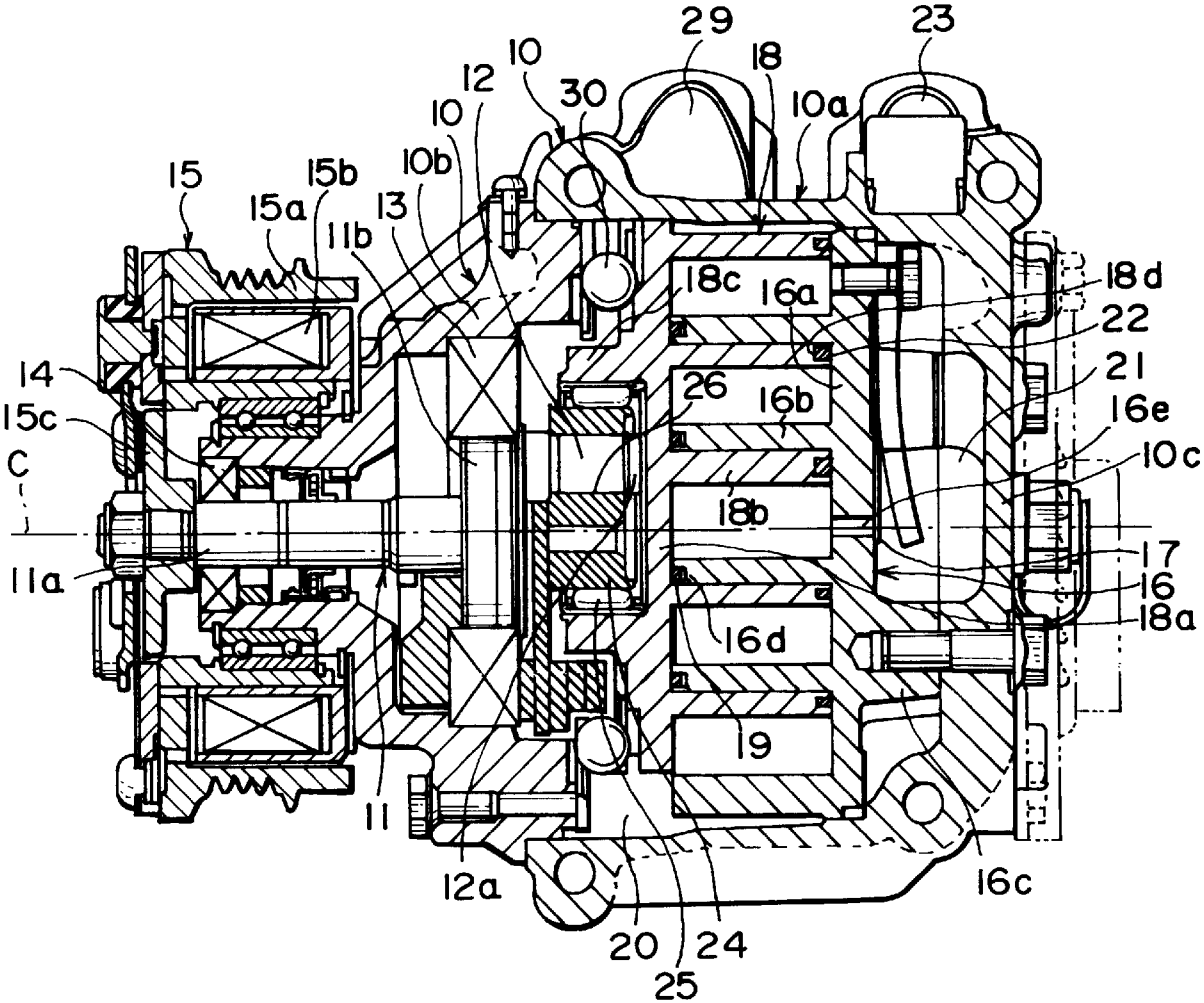
FIG. 1 is a sectional view of a scroll type compressor according to a first preferred embodiment of the present invention.

Referring to FIG. 1, description will be made as regards a scroll type compressor according to a first embodiment of the present invention. The scroll type compressor comprises a housing 10, a shaft 11, a crank pin 12, bearings 13 and 14, an electromagnetic clutch 15, a fixed scroll 16, a discharge valve 17 and a movable scroll 18.

The housing 10 comprises a large-diameter bottomed cylindrical casing 10*a* and a front housing 10*b* fixed to the casing 10*a*. The casing 10*a* and the front housing 10*b* are concentrically arranged with respect to a center axis C of the housing 10 and the shaft 11.

The shaft 11 is disposed on the center axis C and extends into the inside of the housing 10 through the front housing 10*b*. The shaft 11 comprises a small-diameter portion 11*a* and a large-diameter portion 11*b*. The large-diameter portion 11*b* is rotatably supported relative to a large-diameter cylindrical portion, on the right in FIG. 1, of the front housing 10*b* the bearing 13. Further, the small-diameter portion 11*a* is rotatably supported to a small-diameter cylindrical portion, on the left in FIG. 1, of the front housing 10*b* the bearing 14.

The electromagnetic clutch 15 is disposed so as to surround the small-diameter cylindrical portion of the front housing 10*b*. Specifically, a pulley 15*a* rotatably arranged around the small-diameter cylindrical portion of the front housing 10*b*. The pulley 15*a* is rotated by an external driving source (not shown) such as an automobile engine via a V-belt or the like (not shown). An exciting coil 15*b* is fixed to the front housing 10*b*. A clutch armature 15*c* is fixedly coupled to an end of the small-diameter portion 11*a* of the shaft 11 and confronts an axial end surface of the pulley 15*a*. During deenergization to the exciting coil 15*b*, the clutch armature 15*c* is separated from the axial end surface of the pulley 15*a* so that a rotational force of the pulley 15*a* is not transmitted to the shaft 11. On the other hand, upon energization to the exciting coil 15*b*, the clutch armature 15*c* is attracted to the axial end surface of the pulley 15*a* so that the rotational force of the pulley 15*a* is transmitted to the shaft 11 to rotate it.

The fixed scroll 16 is disposed in the casing 10*a*. The fixed scroll 16 comprises a disk-shaped end plate 16*a* securely fitted in the casing 10*a*, a spiral member 16*b* formed on the end plate 16*a* at one side thereof, and a leg portion 16*c* formed on the end plate 16*a* at the other side thereof. At the center of the end plate 16*a* is formed a discharge hole 16*e* which is opened and closed by the discharge valve 17.

The fixed scroll 16 is fixed in the casing 10*a* such that the leg portion 16*c* is in contact with a bottom 10*c* of the casing 10*a* and a bolt is screwed into the leg portion 16*c* through the bottom 10*c* from the exterior thereof. The end plate 16*a* of the fixed scroll 16 divides the interior space of the casing 10*a* into a suction chamber 20 and a discharge chamber 21.

On an end surface of the spiral member 16*b* of the fixed scroll 16, a spirally extending groove 16*d* is formed which receives therein a spiral seal member 19.

The movable scroll 18 is disposed in the casing 10*a* adjacent to the fixed scroll 16. The movable scroll 18 comprises the disk-shaped end plate 18*a*, a spiral member 18*b* formed on the end plate 18*a* at one side thereof, and an annular boss 18*c* formed on the end plate 18*a* at the other side thereof. The spiral member 18*b* of the movable scroll 18 is interfitted or mated with the spiral member 16*b* of the fixed scroll 16 with a phase deviation of 180 degrees. On an end surface of the spiral member 18*b* of the movable scroll 18, a spirally extending groove 18*d* is formed which receives therein a spiral seal member 22.

In the boss 18*c*, a cylindrical bushing 24 is rotatably received via a needle bearing 25. The bushing 24 is formed with a through hole 26 extending in parallel with the center axis C. The crank pin 12 fixed to the large-diameter portion 11*b* of the shaft 11 is received in the through hole 26 so as to be slidable/rotatable relative to it. Accordingly, the movable scroll 18 is supported by the crank pin 12 via the bushing 24 and the needle bearing 25 so as to be slidable/rotatable. Further, between the front housing 10*b* and the movable scroll 18 is arranged a ball coupling mechanism 30 for preventing the movable scroll 18 from rotation on its axis. With the foregoing arrangement, when the shaft 11 is rotated, the movable scroll 18 supported by the crank pin 12 makes a circular orbital motion around the center axis C.

In the scroll type compressor having the foregoing structure, the shaft 11 is rotated by the driving force transmitted from the external driving source via the electromagnetic clutch 15. The rotation of the shaft 11 causes the movable scroll 18 supported by the crank pin 12 to make a circular orbital motion around the center axis C. At this time, the rotation of the movable scroll 18 on its axis is prevented by the ball coupling mechanism 30.

The circular orbital motion of the movable scroll 18 causes spaces, i.e. compressing chambers, defined between the movable scroll 18 (spiral member 18*b* and end plate 18*a*) and the fixed scroll 16 (spiral member 16*b* and end plate 16*a*) to move toward the center of the spiral while reducing their volumes. Thus, fluid including lubricating oil introduced into the suction chamber 20 via a suction port 29 of the housing 10 from an external fluid circuit (not shown) and further introduced into the compressing chambers from peripheral ends of the spiral members 16*b* and 18*b* are compressed in the compressing chambers and then discharged into the discharge chamber 21 via the discharge hole 16*e* of the fixed scroll 16. The compressed fluid discharged into the discharge chamber 21 is conducted into the external fluid circuit via a discharge port 23 of the housing 10.

Assuming that a structure is adopted wherein the shaft 11 is fixed to the bearing 14 and not to the bearing 13, if the shaft 11 is rotated in a state without the bearing 14 (for example, in a state where the bearing 14 is not yet incorporated) during an assembling process, it is possible that the shaft 11 may be dislocated rightward in FIG. 1 along the center axis C. Then, if the shaft 11 is rotated in the dislocated state, it is possible that an end plate 18*a* of the movable scroll 18 confronting an end surface 12*a* of the crank pin 12 and the end surface 12*a* of the crank pin 12 confronting the end plate 18*a* may abut and slide relative to each other so that abrasion powder is produced due to the abutment and sliding of the end plate 18*a* of the movable scroll 18 and the end surface 12*a* of the crank pin 12, or they adhere to each other. The crank pin 12 is attached to an end surface of the large-diameter portion 11*b* of the shaft 11 in a state eccentric and parallel relative to the center axis C.

Figure 2:
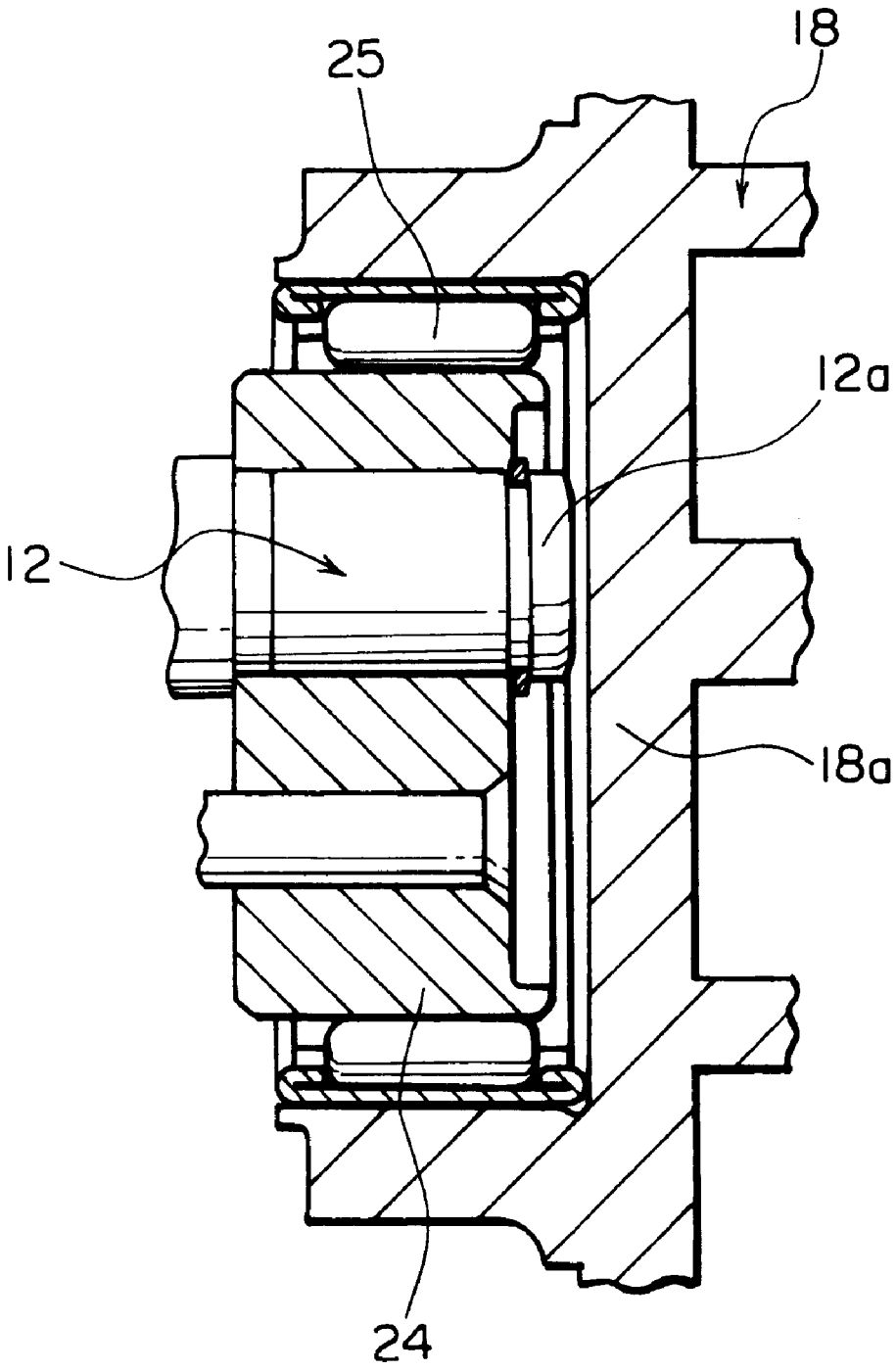
FIG. 2 is a sectional view of the main part of the scroll type compressor shown in FIG. 1.

Referring to FIG. 2, according to the first embodiment of the present invention, a surface treatment for abrasion resistance is applied to at least one of the end plate 18*a* of the movable scroll 18 and the end surface 12*a* of the crank pin 12. Specifically, the surface treatment is carried out by forming an abrasion-resistant layer made of a material which is high in abrasion resistance and fairly free of adhesion, through an alumite treatment, a metal plating treatment, a Teflon coating treatment, a metal thermal spraying treatment or the like.

The end surface 12*a* of the crank pin 12 is chamfered and further has a convex curved surface of a proper diameter. The chamfered surface arrangement and the convex curved surface arrangement both may be omitted or one of them may be omitted.

According to the scroll type compressor, even if the end plate 18*a* of the movable scroll 18 and the end surface 12*a* of the crank pin 12 abut and slide relative to each other in the scroll compressor assembling process as described above, the degree of abrasion can be remarkably reduced by means of the abrasion-resistant layer formed on at least one of the end plate 18*a* of the movable scroll 18 and the end surface 12*a* of the crank pin 12. Thus, the generation of abrasion powder and the adhesion between the end plate 18*a* of the movable scroll 18 and the end surface 12*a* of the crank pin 12 are not liable to occur as compared with the prior art.

As a result, the sliding condition between the end plate 18*a* of the movable scroll 18 and the end surface 12*a* of the crank pin 12 is improved to be smoother so that, for example, fluctuation of values upon measurement of the static shaft torque is reduced. This effect is enhanced by chamfering the end surface 12*a* of the crank pin 12 or forming it as the convex curved surface as described before.

Figure 3:
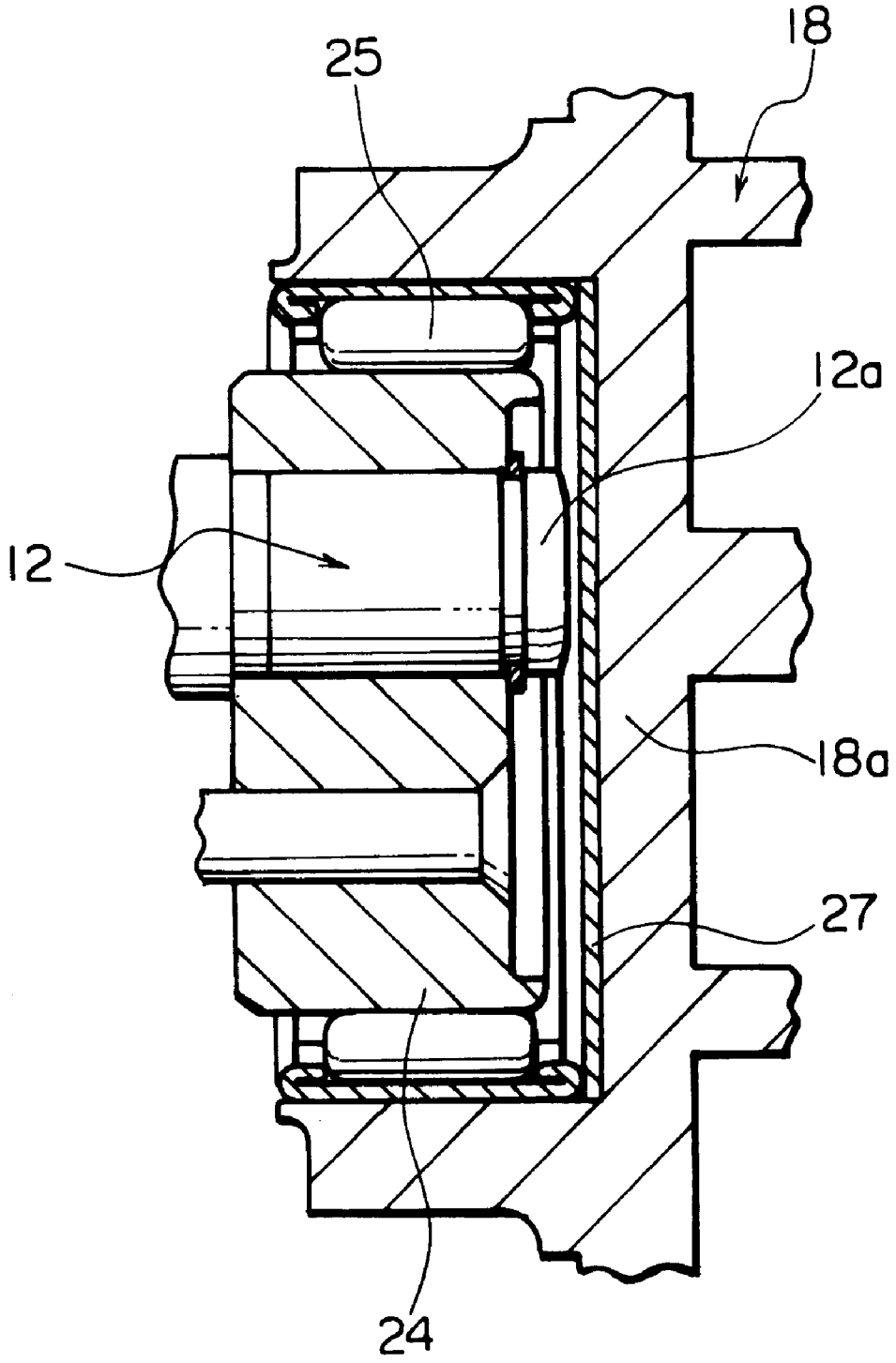
FIG. 3 is a sectional view of the main part of a scroll type compressor according to a second preferred embodiment of the present invention.

Referring to FIG. 3, the description will be made as regards a scroll type compressor according to a second embodiment of the present invention. In the scroll type compressor, instead of forming the abrasion-resistant layer on at least one of the end plate 18*a* of the movable scroll 18 and the end surface 12*a* of the crank pin 12 as in the foregoing scroll type compressor of FIG. 1, an abrasion-resistant plate 27 in the form of a thin plate made of metal or resin is interposed between the end plate 18*a* of the movable scroll 18 and the end surface 12*a* of the crank pin 12. In FIG. 3, peripheral portions of the abrasion-resistant plate 27 are retained between the end plate 18*a* of the movable scroll 18 and the needle bearing 25.

By providing the abrasion-resistant plate 27, the generation of abrasion powder and the adhesion between the end plate 18*a* of the movable scroll 18 and the end surface 12*a* of the crank pin 12 are not liable to occur as in the foregoing scroll type compressor of FIG. 1.

In the scroll type compressor, the abrasion-resistant layer may be further formed on the end surface 12*a* of the crank pin 12, or the end surface 12*a* of the crank pin 12 may further be chamfered or formed as the convex curved surface as in the foregoing scroll type compressor of FIG. 1.

While the present invention has thus far been described in connection with a few embodiments thereof, it will readily be possible for those skilled in the art to put this invention into practice in various other manners.

What is claimed is:

1. A scroll type compressor comprising:

a rotatable shaft extending in an axial direction;

a crank pin eccentrically provided on said shaft and having an end surface perpendicular to said axial direction;

a movable scroll driven by said crank pin and having an end plate confronting said end surface of the crank pin;

a fixed scroll cooperated with said movable scroll for defining a compressing chamber therebetween; and abrasion-resistant means for preventing abrasion between said end surface of the crank pin and said end plate of the movable scroll.

2. A scroll type compressor as claimed in claim 1, wherein said abrasion-resistant means comprises a surface treatment applied to at least one of said end surface of the crank pin and said end plate of the movable scroll for improving a sliding condition therebetween.

3. A scroll type compressor as claimed in claim 2, wherein said surface treatment is applied to said end surface of the crank pin.

4. A scroll type compressor as claimed in claim 1, wherein said abrasion-resistant means comprises an abrasion-resistant plate interposed between said end surface of the crank pin and said end plate of the movable scroll.

5. A scroll type compressor as claimed in claim 4, wherein said abrasion-resistant plate is attached to said end plate of the movable scroll.

6. A scroll type compressor as claimed in claim 4, wherein said abrasion-resistant plate is a thin plate made of metal or resin.

7. A scroll type compressor as claimed in claim 1, wherein said abrasion-resistant means comprises a deforming process applied to said end surface of the crank pin.

8. A scroll type compressor as claimed in claim 7, wherein said deforming process comprises chamfering.

* * * * *